US008991508B2

(12) United States Patent
Chavers et al.

(10) Patent No.: US 8,991,508 B2
(45) Date of Patent: Mar. 31, 2015

(54) PACK OFF DEVICE WITH CABLE FEEDTHROUGH

(75) Inventors: Raymond D. Chavers, Humble, TX (US); Euin H. Vickery, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 382 days.

(21) Appl. No.: 13/486,553

(22) Filed: Jun. 1, 2012

(65) Prior Publication Data

US 2013/0320626 A1 Dec. 5, 2013

(51) Int. Cl.

| | |
|---|---|
| ***E21B 33/122*** | (2006.01) |
| ***E21B 33/12*** | (2006.01) |
| ***E21B 43/12*** | (2006.01) |

(52) U.S. Cl.

CPC ..... *E21B 33/12* (2013.01); *E21B 33/122* (2013.01); *E21B 43/128* (2013.01)

USPC ..... 166/380; 166/241.6; 166/242.3; 166/106

(58) Field of Classification Search

CPC ..... E21B 33/122

USPC ..... 166/380, 241.6, 242.3, 106

See application file for complete search history.

(56) References Cited

U.S. PATENT DOCUMENTS

| | | | | | |
|---|---|---|---|---|---|
| 2,253,092 | A | * | 8/1941 | Pranger | 166/128 |
| 4,605,074 | A | * | 8/1986 | Barfield | 175/4.52 |
| 4,627,490 | A | * | 12/1986 | Moore | 166/65.1 |

OTHER PUBLICATIONS

Halliburton, [online]; [retrieved on Jul. 6, 2012]; retrieved from the Internet http://www.halliburton.com, "Swellpacker® Cable System," Copyright © 2012 Halliburton, 1p.

* cited by examiner

*Primary Examiner* — Cathleen Hutchins

(74) *Attorney, Agent, or Firm* — Cantor Colburn LLP

(57) ABSTRACT

A pack-off device, including a body having a first feedthrough and a second feedthrough formed therein. A projection extends from the body and is operatively arranged to engage a restriction of an adjacent structure. At least one seal element is arranged with the body for sealing the device against the adjacent structure when the projection is engaged with the restriction. A method of arranging and operating a completion system is also included.

18 Claims, 1 Drawing Sheet

PACK OFF DEVICE WITH CABLE FEEDTHROUGH

BACKGROUND

The use of packers and pack-off devices is widespread throughout the downhole drilling and completions industry. Packers or pack-off devices come in a myriad of styles for handling a variety of downhole conditions, environments, and structures. One example that necessitates a unique arrangement for a pack-off device is where one or more cables, lines, fibers, wires, or other auxiliary components must be fed through the pack-off device in addition to a primary tubular string, e.g., as with a pack-off device arranged to isolate between two electric submersible pump (ESP) assemblies in a redundant ESP system. While hydraulic pistons, setting devices, slips, and other actuatable components can be used to accommodate such isolation in a redundant ESP system, these components are relatively complex and require the casing or other tubular in which they are installed to have a sufficiently large diameter. Larger diameter casings require increased time and material, and therefore cost, to complete, and there is consequently an ever-present desire in the industry to reduce the radial dimensions of boreholes and completion equipment. As a result, alternative designs for pack-off devices are always well received in the art, particularly those alternatives that can be effectively deployed in boreholes of smaller dimensions.

SUMMARY

A pack-off device, including a body having a first feedthrough and a second feedthrough formed therein; a projection extending from the body and operatively arranged to engage a restriction of an adjacent structure; and at least one seal element arranged with the body for sealing the device against the adjacent structure when the projection is engaged with the restriction.

A method of arranging and operating a completion system, including arranging a first component of the completion system through a first feedthrough of a pack-off device and a second component of the completion system through a second feedthrough of the pack-off device; landing the pack-off device at a restriction due to a projection of the device dimensionally overlapping the restriction; engaging one or more seal elements of the device with the restriction; and isolating areas on opposite sides of the device from each other.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
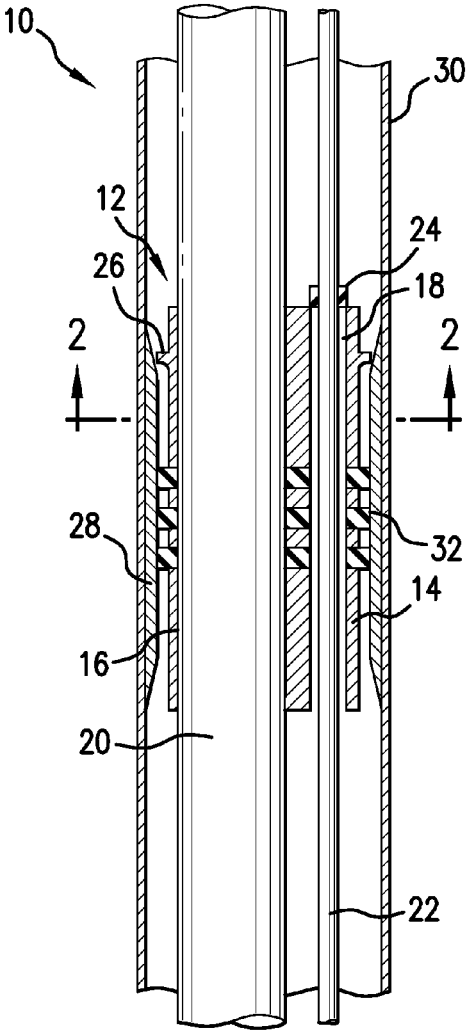
FIG. 1 is a cross-sectional view of a pack-off device according to one embodiment disclosed herein.

Referring now to FIG. 1, a system 10 is shown including a packer or pack-off device 12. The device 12 includes a body 14 having a primary passageway or feedthrough 16 and at least one auxiliary feedthrough 18 formed therein. The primary feedthrough 16 is operatively arranged to receive a tubular string 20, which in one embodiment, is or is included with a production string. The second feedthrough 18 is operatively arranged to receive a control line, electric cable, power lead, wire, fiber, conductor, etc., generally represented as a cable 22. In one embodiment, feedthroughs 16 and 18 are complementarily threaded with respect to the tubular string 20 and/or the cable 22 for securing the string 20 and/or the cable 22 and the body 14 together. In the case of the cable 22 which has a diameter or dimension smaller than that of the feedthrough 18, or FIG. 1, a sealing cap 24 or other member could be secured in or inserted into the feedthrough 18 (e.g., via threads, force fit, etc.) for sealing opposite sides of the feedthrough from each other.

Figure 2:
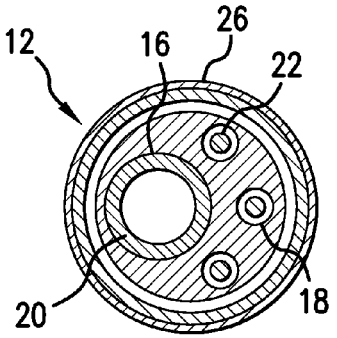
FIG. 2 is a cross-sectional view of the pack-off device of FIG. 1 taken generally along line 2-2.

The terms primary and auxiliary with respect to the feedthroughs 16 and 18 are used for convenience only in discussing the illustrated embodiment and it is to be appreciated that the feedthroughs 16 and 18 could take any relative size or orientation. It is to be further appreciated that multiple ones of the primary or auxiliary feedthroughs 16 and 18 could be included in the body 14 of the device 12. For example, as shown in cross-section in FIG. 2, the body 14 includes three of the auxiliary feedthroughs 18 for enabling a greater number of electric cables, power leads, or other conductors, lines, etc., to extend through the device 12. In order to maximize flow area while minimizing overall dimensions of the device 12 (therefore also minimizing the necessary inner diameter or dimensions of the structure 28), the primary feedthrough 16 can be positioned eccentrically, with the relatively smaller auxiliary feedthroughs 18 arranged at least partially circumferentially about the feedthrough 16 in an arcuate pattern, as illustrated in FIG. 2.

A projection 26 extends from the body 14, radially in the illustrated embodiment, for enabling the body 14 to locate at a restriction 28 in a structure 30. That is, the projection 26 and the restriction 28 radially overlap so that the restriction 28 will block travel of the device 12 and cause the body 14 to land at the restriction 28. In one embodiment the restriction 28 is a polished nipple bore or similar structure having a complementarily formed profile or surface that engages with or against the projection 26 for locating the device 12 within the structure 30. The structure 30 is, for example, a casing, liner, shroud, string, tubular, etc., and is, e.g., run into a borehole while completing the borehole. The device 12 includes one or more seal elements 32 arranged to seal the body 14 within the restriction 28 when the body 14 is located due to the projection 26 landing at the restriction 28. The seal elements 32 are, e.g., elastomeric rings or any other known seal member for enabling isolation between the areas within the structure 30 on opposite sides of the device 12. Advantageously, since the device 12 will be located at the restriction 28 (i.e., due to the projection 26 landing at the restriction 28) and the dimensions of the restriction 28 are known (e.g., machined within certain tolerances), the seal elements 32 can be accordingly configured (in shape, size, material, etc.) to provide a predictably reliable seal against the restriction 28, while occupying a relatively small radial dimension and without the need for any moving components such as slips, pistons, setting assemblies, etc.

Figure 3:
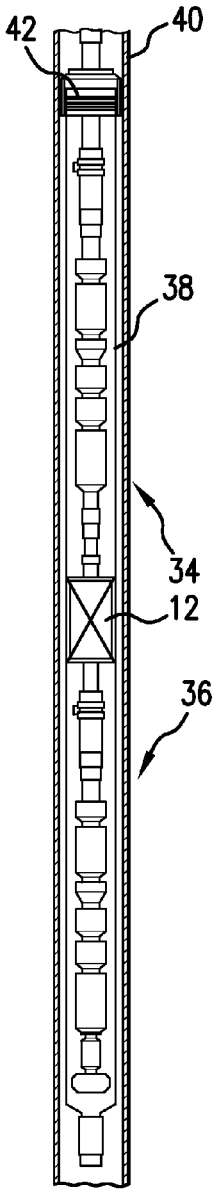
FIG. 3 schematically illustrates a redundant electric submersible pump system including the device of FIG. 1.

In the exemplary embodiment shown in FIG. 3, the device 12 is located between a pair of electric submersible pump (ESP) assemblies 34 and 36. The ESP assemblies 34 and 36 may include suitable motors, pumps, intakes, seals, crossovers, etc., that are generally known in the art. The generically illustrated structure 30 in FIG. 1 is represented with more specificity in FIG. 2 by a shroud 38 that surrounds the assemblies 34 and 36. For example, the shroud 38 is anchored in an outer structure 40, e.g., a cased or lined borehole by a shroud hanger 42. It is to be appreciated that in other embodiments, a shroud may not be included, the device 12 may be directly located in a cased or lined borehole, or some other tubular structure, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A pack-off device, comprising:

a body having a first feedthrough and a second feedthrough formed therein;

a projection extending radially outwardly from the body and operatively arranged to engage a restriction of an adjacent structure; and at least one seal element arranged with the body for sealing the device against the adjacent structure when the projection is engaged with the restriction.

2. The device of claim 1, wherein the first feedthrough is operatively arranged to receive a tubular string therein and the second feedthrough is operatively arranged to receive one or more cables.

3. The device of claim 2, wherein the tubular string and the one or more cables are associated with a redundant electric submersible pump (ESP) assembly.

4. The device of claim 3, wherein the one or more cables include three power leads for the redundant ESP assembly.

5. The device of claim 1, wherein the projection annularly formed on the body.

6. The device of claim 1, wherein the restriction is formed by a polished nipple bore.

7. The device of claim 1, wherein the body includes a plurality of the second feedthroughs therethough.

8. The device of claim 7, wherein the first feedthrough is eccentrically located in the body with the plurality of second feedthroughs arranged in an arcuate pattern at least partially circumferentially about the first feedthrough.

9. The device of claim 1, wherein the first feedthrough is larger than the second feedthrough.

10. A system comprising the device of claim 1 positioned between a first assembly and a second assembly for isolating the first and second assemblies from each other.

11. The system of claim 10, wherein the first and second assemblies are electric submersible pump (ESP) assemblies.

12. The system of claim 11, further comprising a shroud surrounding the first and second ESP assemblies, the shroud including the restriction.

13. The system of claim 10, wherein a production string extends between the first and second assemblies through the first feedthrough and one or more power leads extend between the first and second assemblies through the second feedthrough.

14. A method of arranging and operating a completion system, comprising:

arranging a first component of the completion system through a first feedthrough of a pack-off device and a second component of the completion system through a second feedthrough of the pack-off device;

landing the pack-off device at a restriction due to a projection extending radially outwardly of the device dimensionally overlapping the restriction;

engaging one or more seal elements of the device with the restriction; and isolating areas on opposite sides of the device from each other.

15. The method of claim 14, wherein the completion system includes first and second electric submersible pump assemblies between which the pack-off device is arranged.

16. The method of claim 15, wherein the restriction is located within a shroud enclosing the first and second electric submersible pump assemblies.

17. The method of claim 14, wherein the first component is part of a production string, the method further comprising producing through the first component.

18. The method of claim 14, wherein the second component comprises at least one of a line, a cable, a fiber, and a wire.

* * * * *